US011466542B2

(12) United States Patent
Roy et al.

(10) Patent No.: US 11,466,542 B2
(45) Date of Patent: Oct. 11, 2022

(54) DOWNHOLE DEBRIS REMOVAL APPARATUS INCLUDING A MODULAR KNOCKOUT CHAMBER

(71) Applicant: Halliburton Energy Services, Inc., Houston, TX (US)

(72) Inventors: Todd J. Roy, Lafayette, LA (US); Peter Reid Maher, Lafayette, LA (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/124,617

(22) Filed: Dec. 17, 2020

(65) Prior Publication Data

US 2022/0195844 A1 Jun. 23, 2022

(51) Int. Cl.

| | |
|---|---|
| ***E21B 37/00*** | (2006.01) |
| ***E21B 23/00*** | (2006.01) |
| ***E21B 27/00*** | (2006.01) |

(52) U.S. Cl.

CPC ..... *E21B 37/00* (2013.01); *E21B 23/00* (2013.01); *E21B 27/00* (2013.01)

(58) Field of Classification Search

CPC ..... E21B 37/00; E21B 23/00; E21B 27/00; E21B 27/005; E21B 21/12

See application file for complete search history.

(56) References Cited

U.S. PATENT DOCUMENTS

| | | | | |
|---|---|---|---|---|
| 8,257,585 | B2 * | 9/2012 | Davis | B01D 35/02 210/170.04 |
| 8,387,700 | B2 | 3/2013 | Hern | |
| 8,672,025 | B2 | 3/2014 | Wolf et al. | |
| 9,038,736 | B2 * | 5/2015 | Knobloch, Jr. | E21B 41/0078 166/378 |
| 9,062,507 | B2 * | 6/2015 | Knobloch, Jr. | E21B 27/005 |
| 9,441,435 | B2 * | 9/2016 | Leitch | E21B 43/38 |
| 9,453,383 | B2 | 9/2016 | Telfer | |
| 10,012,047 | B1 | 7/2018 | Alley et al. | |
| 10,072,472 | B2 | 9/2018 | Jensen | |
| 10,309,209 | B2 * | 6/2019 | Caballero | E21B 43/38 |

(Continued)

FOREIGN PATENT DOCUMENTS

| | | | |
|---|---|---|---|
| EP | 2638238 | B1 | 2/2019 |
| WO | 2009120957 | A2 | 10/2009 |

OTHER PUBLICATIONS

"Modular VACS System Cleaned Wellbore and Retrieved Plugs in One Trip," Baker Hughes, 2012, 1 page, www.bakerhughes.com.

*Primary Examiner* — Daniel P Stephenson

(74) *Attorney, Agent, or Firm* — Scott Richardson; Parker Justiss, P.C.

(57) ABSTRACT

This disclosure provides a downhole debris removal apparatus, a method for assembling a downhole debris removal apparatus, and a well system including the same. The downhole debris removal apparatus, in one aspect, includes a crossover sub, the crossover sub having a first sub end with one of a sub pin thread or sub box thread, a second sub end with the other of the sub box thread or sub pin thread, and a fluid passageway extending from the first sub end to the second sub end. The downhole debris removal apparatus, according to this aspect, further includes a debris removal tube having a first tube end and a second tube end, the first tube end removably engaged with the crossover sub between the first sub end and the second end.

22 Claims, 6 Drawing Sheets

(56) References Cited

U.S. PATENT DOCUMENTS

| | | | |
|---|---|---|---|
| 2009/0200010 | A1 | 8/2009 | Davis et al. |
| 2010/0307738 | A1 | 12/2010 | Mouget et al. |
| 2012/0298369 | A1 | 11/2012 | Knobloch, Jr. et al. |
| 2016/0168939 | A1 | 6/2016 | Harris et al. |
| 2018/0135364 | A1 | 5/2018 | Buytaert et al. |

* cited by examiner

DOWNHOLE DEBRIS REMOVAL APPARATUS INCLUDING A MODULAR KNOCKOUT CHAMBER

BACKGROUND

Well operations, such as milling out a tool or pipe in a wellbore or a frac operation, create debris that needs to be collected and removed from the well. For example, a bottom-hole assembly with a mill is made up with a debris collection tool. Debris collection tools are sometimes referred to as junk baskets, collector baskets or debris screens. There are a variety of different collection tools that operate on different principles. However, in general, these various tools have a common objective of separating circulating fluid from the cuttings and/or other debris that is present in the wellbore. In some tools, reverse circulation is created at the lower end of the tubing string and is used to circulate; the debris into a collection tool, Reverse circulation is generally created by using a tool, sometimes referred to as a venturi device (e.g., power head), to direct flow laden with cuttings and/or particulate material into a debris removal assembly.

DETAILED DESCRIPTION

Figure 1:
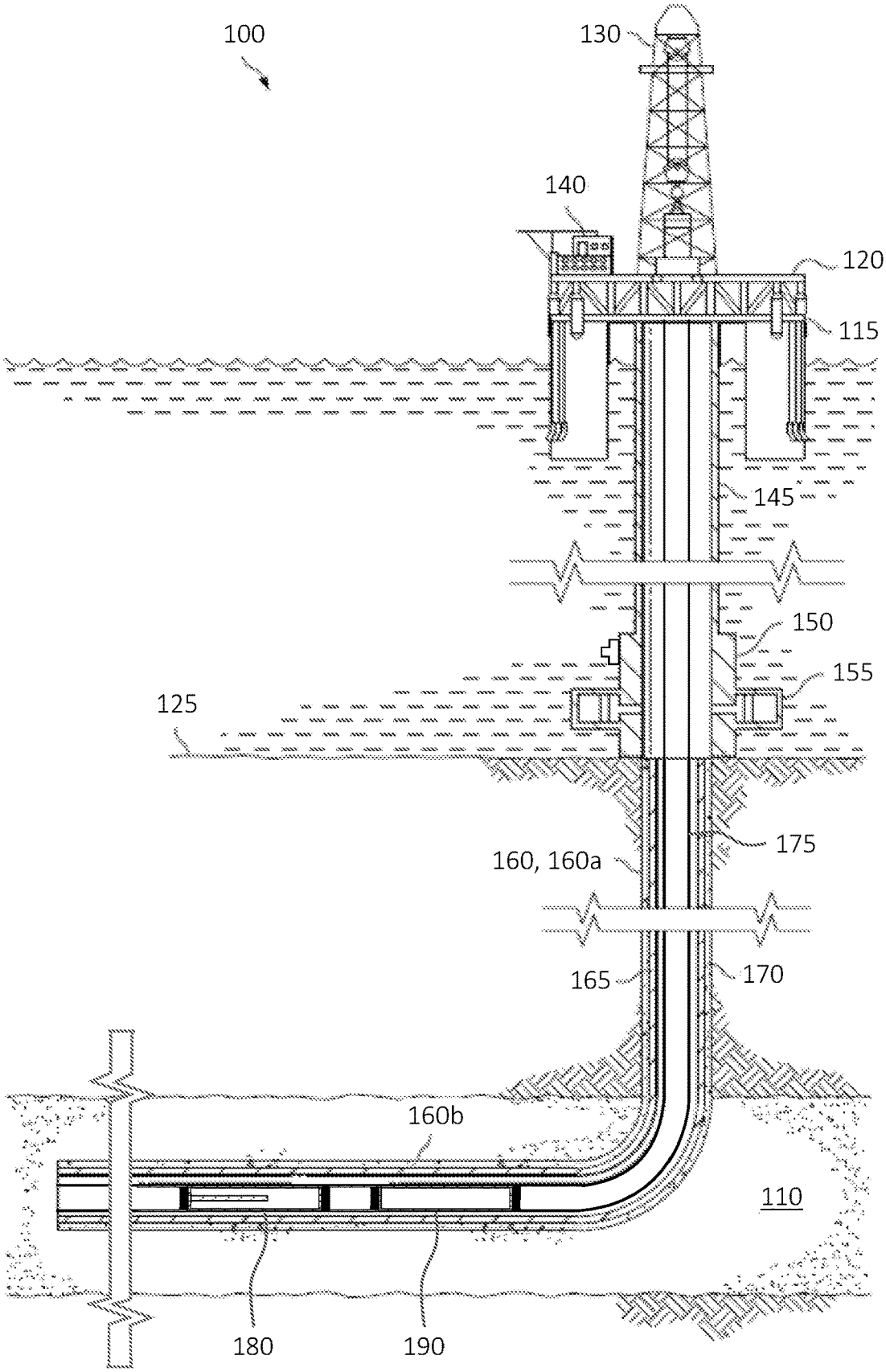
FIG. 1 illustrates a well system including a downhole debris removal apparatus designed, manufactured and/or operated according to the present disclosure.

In the drawings and descriptions that follow, like parts are typically marked throughout the specification and drawings with the same reference numerals, respectively. The drawn figures are not necessarily, but may be, to scale. Certain features of the disclosure may be shown exaggerated in scale or in somewhat schematic form and some details of certain elements may not be shown in the interest of clarity and conciseness.

The present disclosure may be implemented in embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results. Moreover, all statements herein reciting principles and aspects of the disclosure, as well as specific examples thereof, are intended to encompass equivalents thereof. Additionally, the term, "or," as used herein, refers to a non-exclusive or, unless otherwise indicated.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "uphole," "upstream," or other like terms shall be construed as generally toward the surface of the well; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical or horizontal axis. Unless otherwise specified, use of the term "subterranean formation" shall be construed as encompassing both areas below exposed earth and areas below earth covered by water, such as ocean or fresh water.

Referring initially to FIG. 1, schematically illustrated is a well system 100, including a downhole debris removal apparatus 180 designed, manufactured and/or operated according to at least one embodiment of the present disclosure. The well system 100 of FIG. 1, without limitation, includes a semi-submersible platform 115 having a deck 120 positioned over a subterranean (e.g., oil and gas) formation 110, which in this embodiment is located below sea floor 125. The platform 115, in the illustrated embodiment, may include a hoisting apparatus/derrick 130 for raising and lowering various oil and gas components, such as conveyances, work string, production tubing, etc. The well system 100 illustrated in FIG. 1 may additionally include a control system 140 located on the deck 120, or elsewhere. The control system 140, in one embodiment, may be used to control various different aspects of the well system 100.

A subsea conduit 145 extends from the platform 115 to a wellhead installation 150, which may include one or more subsea blow-out preventers 155. A wellbore 160 extends through the various earth strata including the subterranean formation 110. In the embodiment of FIG. 1, wellbore casing 165 is cemented within wellbore 160 by cement 170, and includes a conveyance 175 therein. The conveyance 175 may be any known conveyance, nevertheless in one or more embodiments the conveyance 175 is work string or production string.

In the illustrated embodiment, wellbore 160 has an initial, generally vertical portion 160*a* and a lower, generally deviated portion 160*b*, which is illustrated as being horizontal. It should be noted by those skilled in the art, however, that the downhole debris removal apparatus 180 of the present disclosure is equally well-suited for use in other well configurations including, but not limited to, inclined wells, wells with restrictions, non-deviated wells and the like. Moreover, while the wellbore 160 is positioned below the sea floor 125 in the illustrated embodiment of FIG. 1, those skilled in the art understand that the principles of the present disclosure are equally as applicable to other subterranean formations, including those encompassing both areas below exposed earth and areas below earth covered by water such as ocean or fresh water.

In accordance with one embodiment of the disclosure, the downhole debris removal apparatus 180 includes a crossover sub. The crossover sub, in at least one embodiment of the disclosure, has a first sub end with one of a sub pin thread or sub box thread, a second sub end with the other of the sub box thread or sub pin thread, and a fluid passageway extending from the first sub end to the second sub end. The pin and box threads, as disclosed herein, may be rotary shoulder connections in one or more embodiments of the disclosure. The downhole debris removal apparatus 180, in accordance with one embodiment, additionally includes a debris removal tube having a first tube end and a second tube end, the first tube end removably engaged with the crossover sub between the first sub end and the second end.

In at least one embodiment, the downhole debris removal apparatus 180 additionally includes a downhole tubular engaged with the crossover sub and surrounding the debris removal tube. The downhole tubular, in this embodiment, may have a first tubular end with a tubular pin thread engaging the sub box thread of the crossover sub and a second tubular end with a tubular box thread. The downhole tubular, in at least one embodiment, may be drill string having a pin thread at one end and a box thread at the other end. In another embodiment, the downhole tubular is casing string having a pin thread at one end and a box thread at the other end. In another embodiment, the downhole tubular is tubing string having a pin thread at one end and a box thread at the other end. In at least one embodiment, as the downhole debris removal apparatus includes one of the foregoing tubulars, the downhole debris removal apparatus may be modular in nature, and thus may be easily assembled at the well site or rig floor.

Coupled to the downhole debris removal apparatus 180 (e.g., positioned uphole of the downhole debris removal apparatus 180) in the embodiment of FIG. 1 is a venturi device (e.g., power head) 190. The venturi device (e.g., power head) 190, in this embodiment, is operable to provide fluid circulation through the downhole debris removal apparatus 180.

Figure 2:
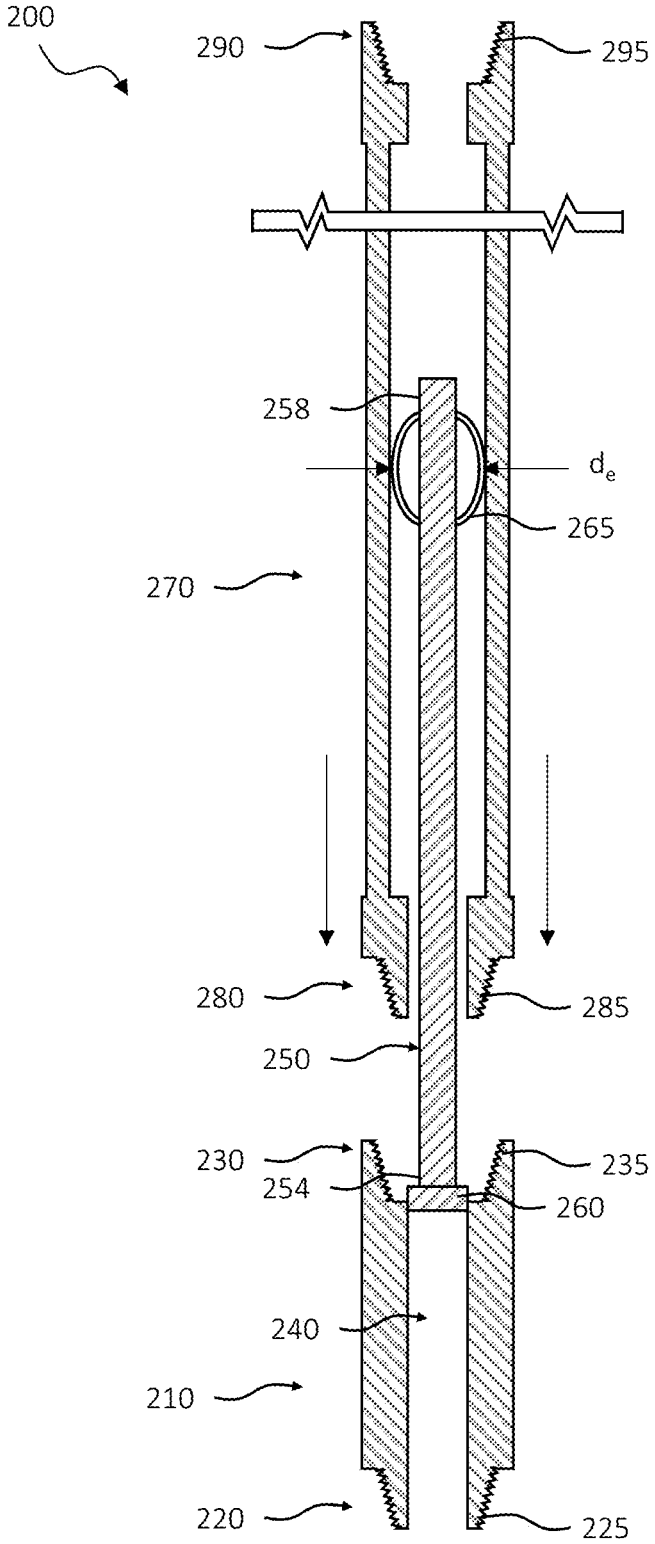
FIG. 2 illustrates a downhole debris removal apparatus designed, manufactured and operated according to one or more embodiments of the disclosure.

Referring now to FIG. 2, schematically illustrated is a cross-sectional view of a downhole debris removal apparatus 200 designed, manufactured and operated according to one or more embodiments of the disclosure. The downhole debris removal apparatus 200, in the illustrated embodiment, includes a crossover sub 210. The crossover sub 210, in one or more embodiments, has a first sub end 220 with one of a sub pin thread or sub box thread, a second sub end 230 with the other of the sub box thread or sub pin thread, and a fluid passageway 240 extending from the first sub end 220 to the second sub end 230. In the embodiment illustrated in FIG. 2, the first sub end 220 includes a sub pin thread 225, and the second sub end 230 includes a sub box thread 235. Nevertheless, the opposite could apply, wherein the first sub end 220 would include a sub box thread and the second sub end 230 would include a sub pin thread.

The downhole debris removal apparatus 200 additionally includes a debris removal tube 250 removably engaged with the crossover sub 210. The debris removal tube 250, in at least one or more embodiments, has a first tube end 254 and a second tube end 258. In the illustrated embodiment, the first tube end 254 is removably engaged with the crossover sub 210 between the first sub end 220 and the second sub end 230, and the second tube end 258 is uncapped. In at least one embodiment, a thread adapter 260 threadingly engages the debris removal tube 250 with the crossover sub 210.

In one or more embodiments, the debris removal tube 250 additionally includes two or more centralizers 265 extending radially outward therefrom. In accordance with one or more embodiments of the disclosure, the two or more centralizers 265 are not rigid in nature, but move between a radially retracted state and a radially extended state. For example, in at least one embodiment, the two or more centralizers 265 might be in the radially retracted state as they move through the neck of a tool joint of a downhole tubular, but be in the radially extended state once they move past the neck of the tool joint of the downhole tubular. A diameter ($d_e$) of the two or more centralizers 265 in the radially extended state and a diameter ($d_r$) of the two or more centralizers 265 in the radially retracted state may vary greatly and remain within the scope of the disclosure. Nevertheless, in at least one embodiment, the diameter ($d_e$) of the two or more centralizers 265 in the radially extended state is at least 110 percent of a diameter ($d_r$) of the two or more centralizers 265 in the radially retracted state. In yet another embodiment, the diameter ($d_e$) of the two or more centralizers 265 in the radially extended state is at least 150 percent of a diameter ($d_r$) of the two or more centralizers 265 in the radially retracted state.

A variety of different centralizers 265 may be used and remain within the scope of the disclosure. In one embodiment, for example where it is desirable for the two or more centralizers 265 to be able to move between the radially extended state and the radially retracted state, the centralizers could be two or more bow springs. In yet another embodiment, not shown, the two or more centralizers 265 could be two or more fins that are urged radially outward by two or more related springs. While a few examples have been given for centralizers 265 capable of moving from a radially retracted state to a radially extended state have been given, the present disclosure should not be limited to any specific structure.

The downhole debris removal apparatus 200, in the illustrated embodiment of FIG. 2, additionally includes a downhole tubular 270. The downhole tubular 270 is operable to engage with the crossover sub 210, and surround the debris removal tube 250. For example, in at least one embodiment, the downhole tubular 270 has a first tubular end 280 with a tubular pin thread 285 and a second tubular end 290 with a tubular box thread 295. In accordance with this embodiment, the tubular pin thread 285 would engage the sub box thread 235 of the crossover sub 210, and thus couple the downhole tubular 270 with the crossover sub 210.

The downhole tubular 270, as indicated above, may comprise drill string in one embodiment. In yet another embodiment, the downhole tubular 270 could comprise casing string or tubing string. Accordingly, the downhole debris removal apparatus 200 may be modular in nature, and thus may be easily assembled at the well site or rig floor, for example as the features of the downhole debris removal apparatus 200 may be easily handled and coupled using conventional rig tongs, elevators and slips. Moreover, in at least one embodiment, the downhole debris removal apparatus 200 does not need a handling sub, as is required in various other existing downhole debris removal apparatus. In the illustrated embodiment, the crossover sub 210, the debris removal tube 250 and the downhole tubular 270 form at least a portion of a debris collection sub of the downhole debris removal apparatus 200.

Figure 3:
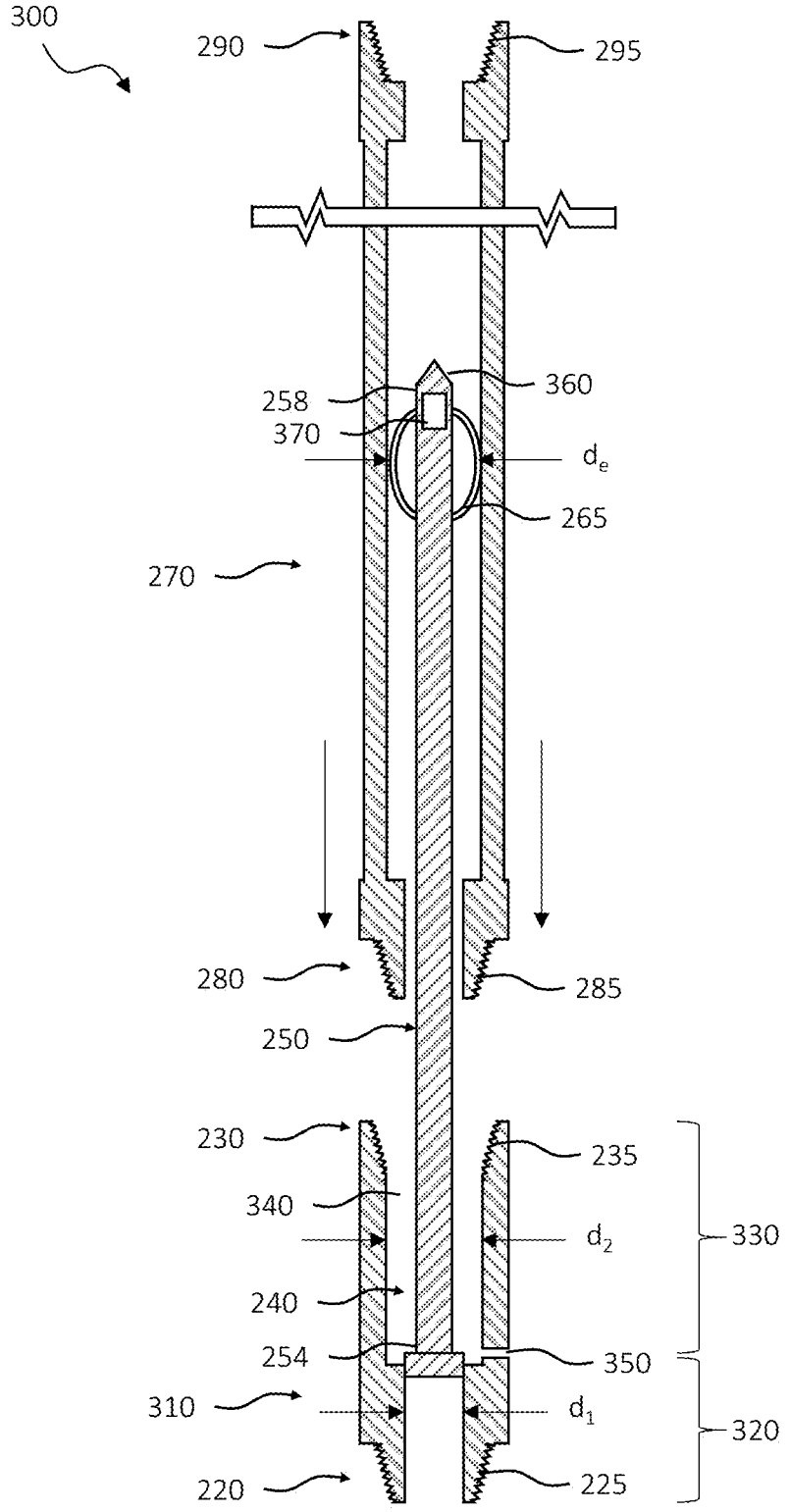
FIG. 3 illustrates a downhole debris removal apparatus designed, manufactured and operated according to one or more alternative embodiments of the disclosure.

Turning to FIG. 3, illustrated is a cross-sectional view of a downhole debris removal apparatus 300 designed, manufactured and/or operated according to an alternative embodiment of the disclosure. The downhole debris removal apparatus 300 is similar in many respects to the downhole debris removal apparatus 200 discussed and illustrated with regard to FIG. 2. Accordingly, like reference numbers have been used to illustrate similar, if not identical, features. The downhole debris removal apparatus 300 differs for the most part from the downhole debris removal apparatus 200, in that the fluid passageway 340 in the crossover sub 310 includes a first section 320 and a second section 330. In the illustrated embodiment, the first section 320 is located proximate the first sub end 220 and the second section 330 is proximate the second sub end 230. In at least one embodiment, the first section 320 has a first diameter ($d_1$) and the second section 330 has a second greater diameter ($d_2$). As is illustrated in FIG. 3, a difference between the first diameter ($d_1$) and the second greater diameter ($d_2$) forms a crossover sub collection chamber 340.

In the illustrated embodiment of FIG. 3, the debris removal tube 250 extends into the second section 330, and is removably engaged with the crossover sub 210 proximate an interface between the first section 320 and the second section 330. The debris removal tube 250 may be threadingly engaged with the crossover sub 210, for example using a thread adapter.

In accordance with one embodiment, the crossover sub 310 includes a debris removal opening 350 coupling an exterior of the collection sub 310 and the crossover sub collection chamber 340. The debris removal opening 350, as is apparent from FIG. 3, allows debris from within the crossover sub collection chamber 340, as well as any debris in the downhole tubular 270, to be removed without having to disassemble the various features of the downhole debris removal apparatus 300. The debris removal opening 350, in at least one embodiment, is located proximate the interface between the first section 320 and the second section 330. While not shown, a debris removal plug may removably engage the debris removal opening 350 from the exterior of the collection sub 310.

The debris removal tube 250, in the illustrated embodiment of FIG. 3, additionally includes a capped end 360. The capped end 360, in one or more embodiments, is operable to reduce a velocity of the fluid and debris exiting the debris removal tube 250. While the capped end 360 is illustrated as a cone shaped capped end (e.g., whether typical cone or an inverted cone), in at least one other embodiment the capped end 360 is a blunt shaped capped end. Further to the embodiment of FIG. 3, the debris removal tube 250 includes one or more sidewall openings 370 for allowing fluid and debris to exit the debris removal tube 250. The size, shape and number of sidewall openings 370 may each vary greatly and remain within the scope of the disclosure.

Figure 4A:
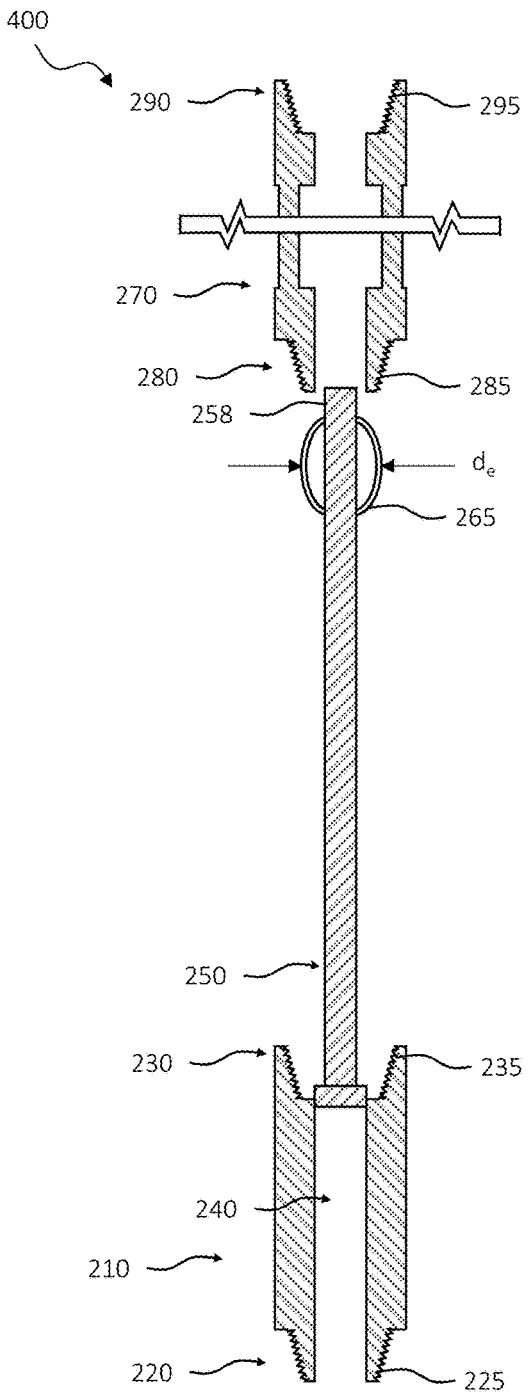
FIGS. 4A through 4D illustrates a method for assembling a downhole debris removal apparatus according to one or more embodiments of the disclosure.

Turning to FIGS. 4A through 4D, illustrated is a method for assembling a downhole debris removal apparatus 400 according to one or more embodiments of the disclosure. The downhole debris removal apparatus 400 is similar in many respects to the downhole debris removal apparatus 200 discussed and illustrated with regard to FIG. 2. Accordingly, like reference numbers have been used to illustrate similar, if not identical, features. FIG. 4A illustrates the downhole debris removal apparatus 400 as the downhole tubular 270 is approaching the second tube end 258 of the debris removal tube 250. At this stage, the two or more centralizers 265 may be in either the radially retracted state or the radially extended state. Nevertheless, the embodiment of FIG. 4A illustrates the two or more centralizers 265 in the radially extended state, which happens to be their steady state in the embodiment shown.

Figure 4B:
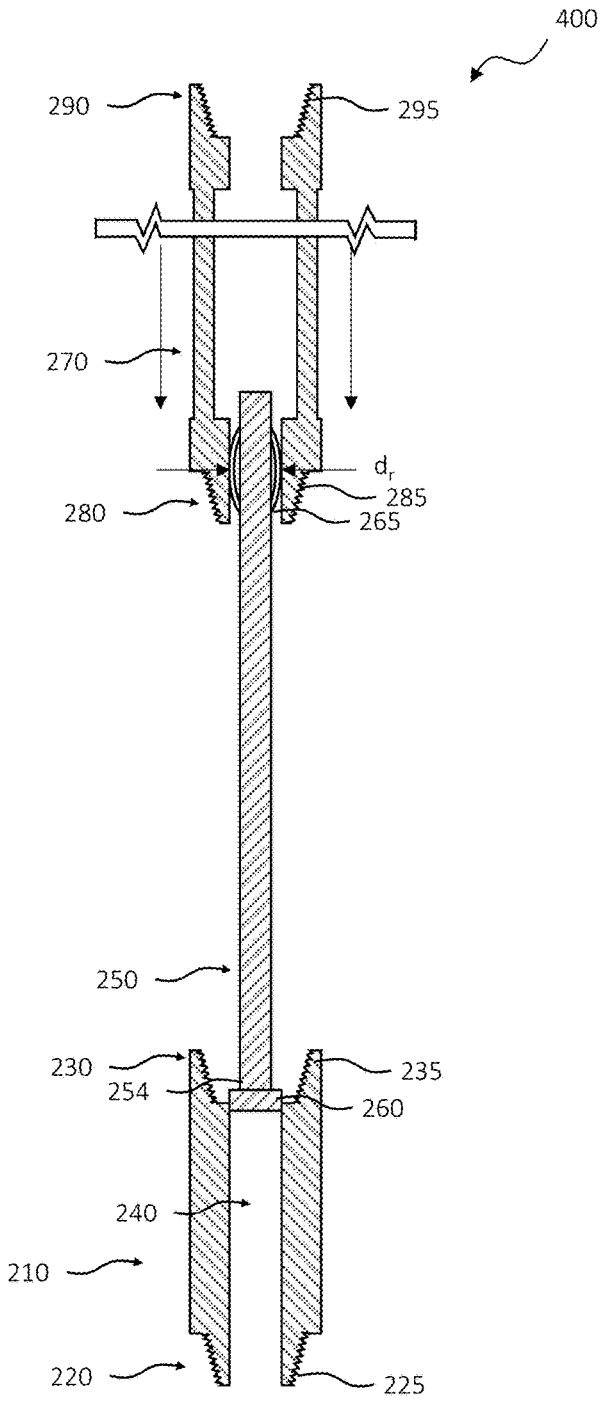

FIG. 4B illustrates the downhole debris removal apparatus 400 after starting to position the debris removal tube 250 within the downhole tubular 270. For example FIG. 4B illustrates the downhole debris removal apparatus 400 as the two or more centralizers 265 are passing through the first tubular end 280 of the downhole tubular 270. As is illustrated, the two or more centralizers 265 are in the radially retracted state as they move through the first tubular end 280 of the downhole tubular 270, and more specifically as they pass through the neck of the downhole tubular 270 tool joint.

Figure 4C:
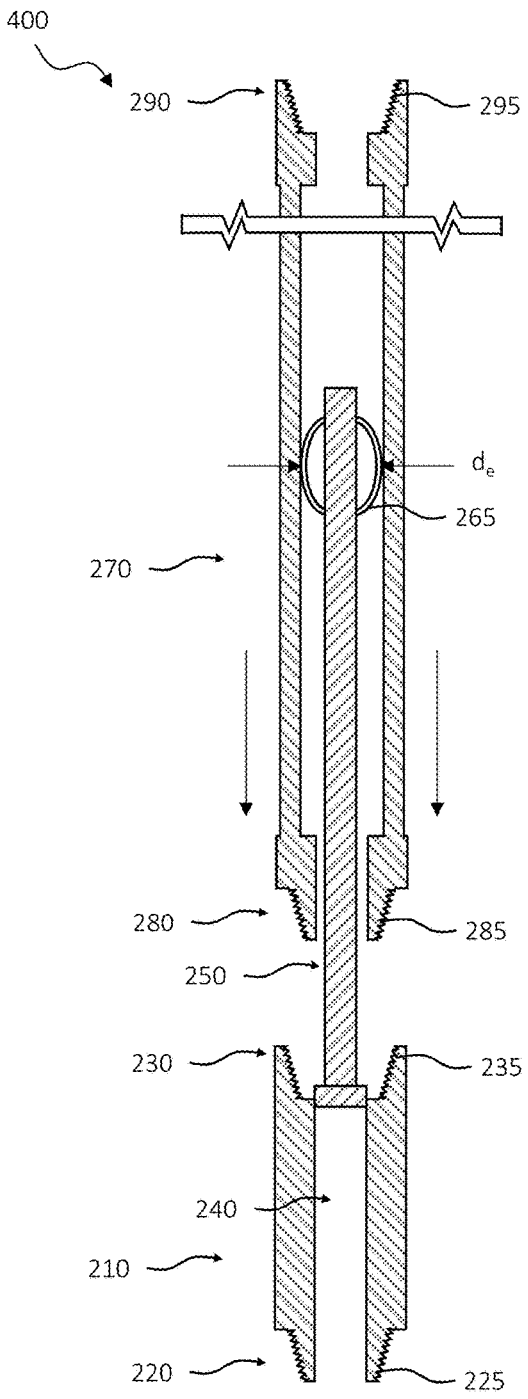

FIG. 4C illustrates the downhole debris removal apparatus 400 as the first tubular end 280 of the downhole tubular 270 continues to move toward the second sub end 230 of the crossover sub 210. At this stage, the two or more centralizers 265 move from the radially retracted state to the radially extended state, thereby centering the debris removal tube 250 within a main passageway of the downhole tubular 270.

Figure 4D:
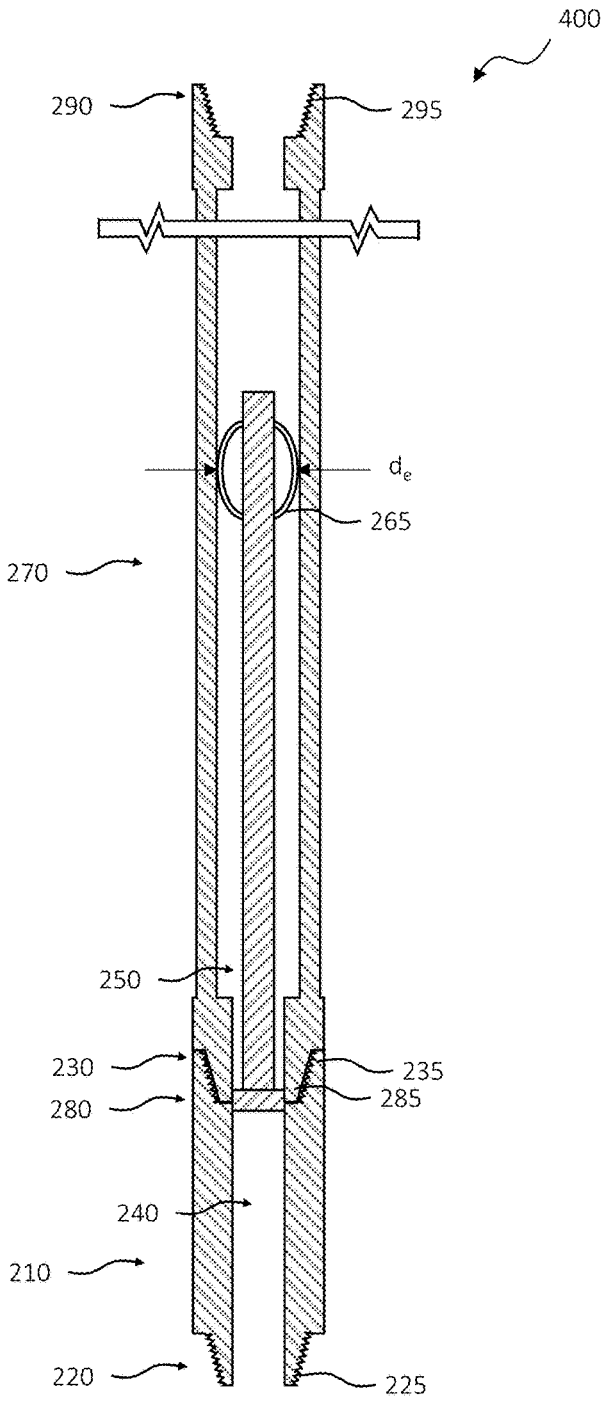

FIG. 4D illustrates the downhole debris removal apparatus 400 after fixing the downhole tubular 270 to the debris collection sub 210. In at least one embodiment, this is accomplished by coupling the tubular pin thread 285 of the downhole tubular 270 to the sub box thread 235 of the crossover sub 210.

Figure 5:
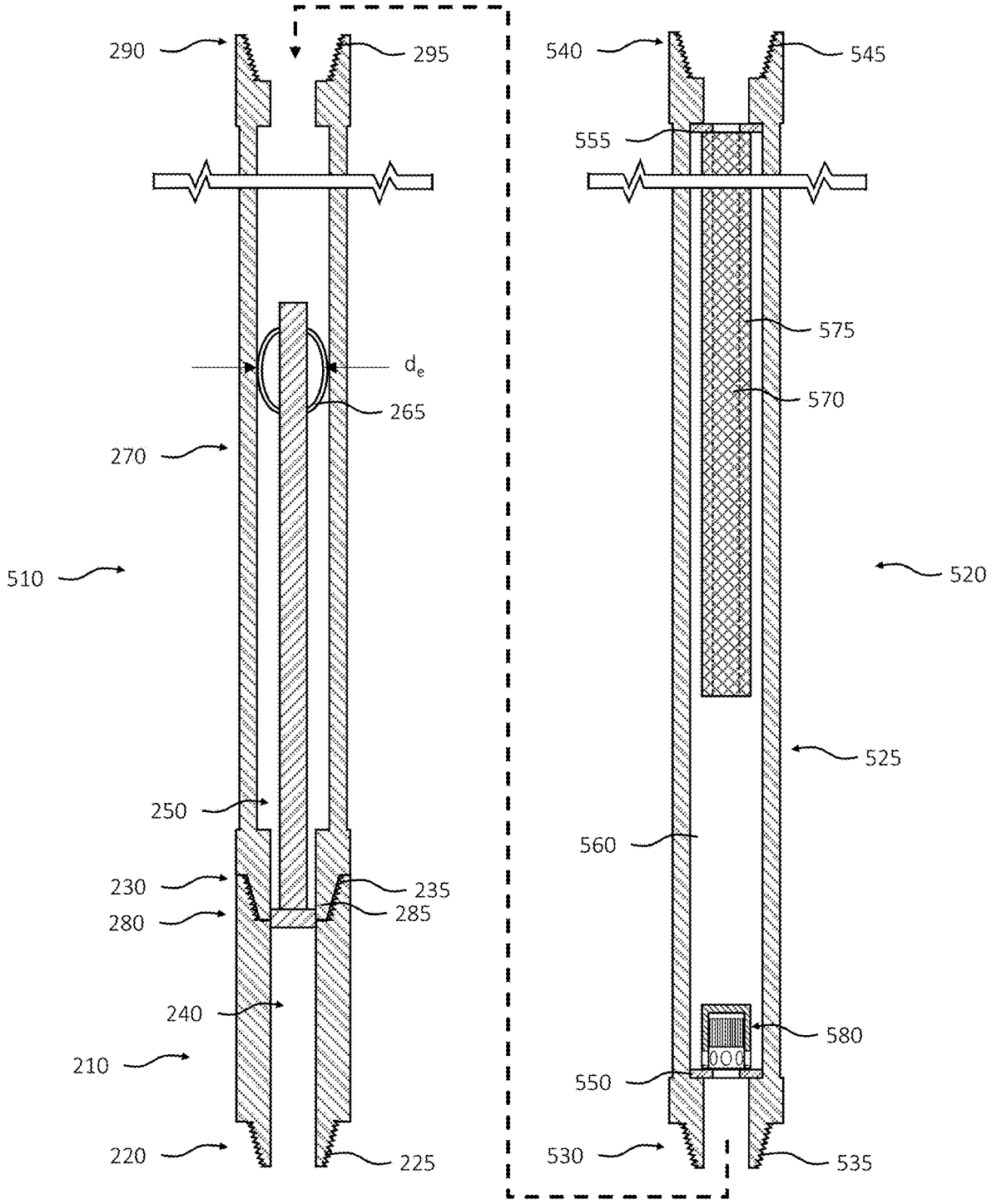
FIG. 5 illustrates a downhole debris removal apparatus designed, manufactured and operated according to yet one or more additional embodiments of the disclosure.

Turning to FIG. 5, illustrated is a cross-sectional view of a downhole debris removal apparatus 500 designed, manufactured and operated according to one or more alternative embodiments of the disclosure. The downhole debris removal apparatus 500 is similar in many respects to the downhole debris removal apparatus 200 discussed and illustrated with regard to FIG. 2. Accordingly, like reference numbers have been used to illustrate similar, if not identical, features. The downhole debris removal apparatus 500, in the illustrated embodiment, includes a debris collection sub 510 coupled to a debris removal sub 520. As illustrated, a handling sub is not required to be positioned between the debris collection sub 510 and the debris removal sub 520. In accordance with one or more embodiments of the disclosure, the debris collection sub 510 includes the crossover sub 210, the debris removal tube 250, and the downhole tubular 270.

The debris removal sub 520, in accordance with one or more embodiments of the disclosure, includes a tubular 525. The tubular 525 may comprise a variety of different tubulars and remain within the scope of the disclosure. In one embodiment, the tubular 525 is a steel tubular, such as an American Petroleum Institute (API) pipe. In accordance with one or more embodiments of the disclosure, the tubular 525 may have a pair of connectors for coupling the debris removal sub 520 to the debris collection sub 510, as well as coupling the debris removal sub 520 to an additional uphole sub (e.g., a venturi device). For example, in at least one embodiment, the tubular 525 has a first tubular end 530 with a tubular pin thread 535 and a second tubular end 540 with a tubular box thread 545. In accordance with this embodiment, the tubular pin thread 535 would engage the tubular box thread 295 of the downhole tubular 270, and thus couple the debris collection sub 510 and the debris removal sub 520.

Positioned at opposing ends within the tubular 525 in the embodiment of FIG. 5 are a first base plate 550 and a second base plate 555. The first base plate 550, in the illustrated embodiment, is located proximate a downhole end of the tubular 525. Likewise, the second base plate 555, in the illustrated embodiment, is located proximate an uphole end of the tubular 525. The first and second base plates 550, 555, as shown, may include openings extending there through for allowing fluid to enter, traverse and exit the debris removal sub 520. Furthermore, the first base plate 550 may form a debris collection chamber 560 in the tubular 525.

In the illustrated embodiment, an inner pipe 570 is positioned within the tubular 525. The inner pipe 570, in the illustrated embodiment, extends partially downward into the tubular 525 from the second base plate 555. In other embodiments, however, the inner piper 570 might extend substantially downward into the tubular 525, or possibly entirely downward into the tubular 525. In the embodiment of FIG. 5, the inner pipe 570 includes a plurality of openings or slots therein (not shown) for allowing fluid to move from an exterior of the inner pipe 570 to an interior of the inner pipe 570.

Positioned around the inner pipe 570, in the embodiment of FIG. 5, is a filtration member 575. The filtration member 575, as illustrated, may substantially encircle the inner pipe 570. In accordance with one embodiment, the filtration member 575 is a screen assembly. In accordance with another embodiment, the filtration member 575 might be a mesh assembly, or any other known or hereafter discovered filtration member. The filtration member 575 may have many different filter porosities and remain within the scope of the disclosure, for example depending on a size of the particulate matter that is being filtered out.

The debris removal sub 520 illustrated in the embodiment of FIG. 5 may additionally include a check valve 580 positioned proximate the first base plate 550. The check valve 580, in the illustrated embodiment, is operable to be open during reverse flow and closed during normal flow. In the embodiment shown, the check valve 580 and the first base plate 550 help define the collection chamber 560. In the absence of the check valve 580, an inner pipe could be used.

Aspects disclosed herein include:

A. A downhole debris removal apparatus, the downhole debris removal apparatus including: 1) a crossover sub, the crossover sub having a first sub end with one of a sub pin thread or sub box thread, a second sub end with the other of the sub box thread or sub pin thread, and a fluid passageway extending from the first sub end to the second sub end; and 2) a debris removal tube having a first tube end and a second tube end, the first tube end removably engaged with the crossover sub between the first sub end and the second sub end.

B. A method for assembling a downhole debris removal apparatus, the method including: 1) providing a debris collection sub, the debris collection sub including; a) a crossover sub, the crossover sub having a first sub end with a sub pin thread, a second sub end with a sub box thread, and a fluid passageway extending from the first sub end to the second sub end; and b) a debris removal tube having a first tube end and a second tube end, the first tube end removably engaged with the crossover sub between the first sub end and the second sub end, the debris removal tube including two or more centralizers extending radially outward therefrom, the two or more centralizers having a radially retracted state and a radially extended state; 2) positioning the debris removal tube of the debris collection sub within a downhole tubular, the downhole tubular having a first tubular end with a tubular pin thread and a second tubular end with a tubular box thread; and 3) fixing the downhole tubular to the debris collection sub by coupling the tubular pin thread of the downhole tubular and the sub box thread of the crossover sub.

C. A well system, the well system including: 1) a wellbore extending into a subterranean formation; 2) a conveyance located within the wellbore; 3) a downhole debris removal apparatus positioned within the wellbore with the conveyance, the downhole debris removal apparatus including: a) a crossover sub, the crossover sub having a first sub end with a sub pin thread, a second sub end with a sub box thread, and a fluid passageway extending from the first sub end to the second sub end; and b) a debris removal tube having a first tube end and a second tube end, the first tube end removably engaged with the crossover sub between the first sub end and the second sub end, the debris removal tube including two or more centralizers extending radially outward therefrom, the two or more centralizers having a radially retracted state and a radially extended state; and c) a downhole tubular engaged with the crossover sub and surrounding the debris removal tube, the downhole tubular having a first tubular end with a tubular pin thread engaging the sub box thread of the crossover sub and a second tubular end with a tubular box thread; and 4) a venturi device coupled to the downhole debris removal apparatus, the power head operable to provide fluid circulation through the downhole debris removal apparatus.

Aspects A, B and C may have one or more of the following additional elements in combination: Element 1: wherein the debris removal tube includes two or more centralizers extending radially outward therefrom. Element 2: wherein the two or more centralizers include a radially retracted state and a radially extended state. Element 3: wherein a diameter ($d_e$) of the two or more centralizers in the radially extended state is at least 110 percent of a diameter ($d_r$) of the two or more centralizers in the radially retracted state. Element 4: wherein the two or more centralizers are two or more bow springs. Element 5: wherein a diameter ($d_e$) of the two or more centralizers in the radially extended state is at least 150 percent of a diameter ($d_r$) of the two or more centralizers in the radially retracted state. Element 6: wherein the first sub end has a pin thread and the second sub end has a box thread. Element 7: wherein the debris removal tube is threadingly engaged with the crossover sub. Element 8: wherein the fluid passageway has a first section proximate the first sub end with a first diameter ($d_1$) and a second section proximate the second sub end with a second greater diameter ($d_2$), a difference between the first diameter ($d_1$) and the second greater diameter ($d_2$) forming a crossover sub collection chamber. Element 9: wherein the debris removal tube extends into the second section and is removably engaged with the crossover sub proximate an interface between the first section and the second section. Element 10: wherein the debris removal tube is threadingly engaged with the crossover sub. Element 11: further including a debris removal opening coupling an exterior of the collection sub and the crossover sub collection chamber. Element 12: wherein the debris removal opening is located proximate an interface between the first section and the second section. Element 13: further including a debris removal plug removably engaging the debris removal opening from the exterior of the collection sub. Element 14: wherein the debris removal tube is uncapped proximate the second tube end for allowing debris to exit the debris removal tube. Element 15: wherein the debris removal tube is capped proximate the second tube end, the debris removal tube including one or more sidewall openings for allowing debris to exit the debris removal tube. Element 16: wherein the first sub end has a sub pin thread and the second sub end has a sub box thread, and further including a downhole tubular engaged with the crossover sub and surrounding the debris removal tube, the downhole tubular having a first tubular end with a tubular pin thread engaging the sub box thread of the crossover sub and a second tubular end with a tubular box thread. Element 17: wherein the crossover sub, debris removal tube, and downhole tubular form at least a portion of a debris collection sub, and further including a debris removal sub coupled to the debris collection sub. Element 18: wherein a pin thread of the debris removal sub engages the tubular box thread of the downhole tubular. Element 19: wherein positioning the debris removal tube within the downhole tubular includes passing the two or more centralizers in the radially retracted state through the first tubular end of the downhole tubular and then allowing the two or more centralizes to move from the radially retracted state to the radially extended state when the two or more centralizers reach a main passageway of the downhole tubular, and then fixing the downhole tubular to the debris collection sub. Element 20: further including coupling a pin thread of a debris removal sub to the tubular box thread of the downhole tubular.

Those skilled in the art to which this application relates will appreciate that other and further additions, deletions, substitutions and modifications may be made to the described embodiments.

What is claimed is:

1. A downhole debris removal apparatus, comprising:

a crossover sub, the crossover sub having a first sub end with one of a sub pin thread or sub box thread, a second sub end with the other of the sub box thread or sub pin thread, and a fluid passageway extending from the first sub end to the second sub end;

a debris removal tube having a first tube end and a second tube end, the first tube end removably engaged with the crossover sub between the first sub end and the second sub end; and two or more centralizers extending radially outward from the debris removal tube, the two or more centralizers operable to move between a radially retracted state and a radially extended state.

2. The downhole debris removal apparatus as recited in claim 1, wherein a diameter ($d_e$) of the two or more centralizers in the radially extended state is at least 110 percent of a diameter ($d_r$) of the two or more centralizers in the radially retracted state.

3. The downhole debris removal apparatus as recited in claim 2, wherein the two or more centralizers are two or more bow springs.

4. The downhole debris removal apparatus as recited in claim 1, wherein a diameter ($d_e$) of the two or more centralizers in the radially extended state is at least 150 percent of a diameter ($d_r$) of the two or more centralizers in the radially retracted state.

5. The downhole debris removal apparatus as recited in claim 1, wherein the first sub end has a pin thread and the second sub end has a box thread.

6. The downhole debris removal apparatus as recited in claim 5, wherein the debris removal tube is threadingly engaged with the crossover sub.

7. The downhole debris removal apparatus as recited in claim 1, wherein the fluid passageway has a first section proximate the first sub end with a first diameter ($d_1$) and a second section proximate the second sub end with a second greater diameter ($d_2$), a difference between the first diameter ($d_1$) and the second greater diameter ($d_2$) forming a crossover sub collection chamber.

8. The downhole debris removal apparatus as recited in claim 7, wherein the debris removal tube extends into the second section and is removably engaged with the crossover sub proximate an interface between the first section and the second section.

9. The downhole debris removal apparatus as recited in claim 8, wherein the debris removal tube is threadingly engaged with the crossover sub.

10. The downhole debris removal apparatus as recited in claim 7, further including a debris removal opening coupling an exterior of the collection sub and the crossover sub collection chamber.

11. The downhole debris removal apparatus as recited in claim 10, wherein the debris removal opening is located proximate an interface between the first section and the second section.

12. The downhole debris removal apparatus as recited in claim 11, further including a debris removal plug removably engaging the debris removal opening from the exterior of the collection sub.

13. The downhole debris removal apparatus as recited in claim 1, wherein the debris removal tube is uncapped proximate the second tube end for allowing debris to exit the debris removal tube.

14. The downhole debris removal apparatus as recited in claim 1, wherein the debris removal tube is capped proximate the second tube end, the debris removal tube including one or more sidewall openings for allowing debris to exit the debris removal tube.

15. The downhole debris removal apparatus as recited in claim 1, wherein the first sub end has a sub pin thread and the second sub end has a sub box thread, and further including a downhole tubular engaged with the crossover sub and surrounding the debris removal tube, the downhole tubular having a first tubular end with a tubular pin thread engaging the sub box thread of the crossover sub and a second tubular end with a tubular box thread.

16. The downhole debris removal apparatus as recited in claim 15, wherein the crossover sub, debris removal tube, and downhole tubular form at least a portion of a debris collection sub, and further including a debris removal sub coupled to the debris collection sub.

17. The downhole debris removal apparatus as recited in claim 16, wherein a pin thread of the debris removal sub engages the tubular box thread of the downhole tubular.

18. A method for assembling a downhole debris removal apparatus, comprising:

providing a debris collection sub, the debris collection sub including;

a crossover sub, the crossover sub having a first sub end with a sub pin thread, a second sub end with a sub box thread, and a fluid passageway extending from the first sub end to the second sub end; and a debris removal tube having a first tube end and a second tube end, the first tube end removably engaged with the crossover sub between the first sub end and the second sub end, the debris removal tube including two or more centralizers extending radially outward therefrom, the two or more centralizers having a radially retracted state and a radially extended state;

positioning the debris removal tube of the debris collection sub within a downhole tubular, the downhole tubular having a first tubular end with a tubular pin thread and a second tubular end with a tubular box thread; and fixing the downhole tubular to the debris collection sub by coupling the tubular pin thread of the downhole tubular and the sub box thread of the crossover sub.

19. The method as recited in claim 18, wherein positioning the debris removal tube within the downhole tubular includes passing the two or more centralizers in the radially retracted state through the first tubular end of the downhole tubular and then allowing the two or more centralizes to move from the radially retracted state to the radially extended state when the two or more centralizers reach a main passageway of the downhole tubular, and then fixing the downhole tubular to the debris collection sub.

20. The method as recited in claim 19, further including coupling a pin thread of a debris removal sub to the tubular box thread of the downhole tubular.

21. A well system, comprising:

a wellbore extending into a subterranean formation;

a conveyance located within the wellbore;

a downhole debris removal apparatus positioned within the wellbore with the conveyance, the downhole debris removal apparatus including:

a crossover sub, the crossover sub having a first sub end with a sub pin thread, a second sub end with a sub box thread, and a fluid passageway extending from the first sub end to the second sub end;

a debris removal tube having a first tube end and a second tube end, the first tube end removably engaged with the crossover sub between the first sub end and the second sub end, the debris removal tube including two or more centralizers extending radially outward therefrom, the two or more centralizers having a radially retracted state and a radially extended state; and a downhole tubular engaged with the crossover sub and surrounding the debris removal tube, the downhole tubular having a first tubular end with a tubular pin thread engaging the sub box thread of the crossover sub and a second tubular end with a tubular box thread; and a venturi device coupled to the downhole debris removal apparatus, the power head operable to provide fluid circulation through the downhole debris removal apparatus.

22. A downhole debris removal apparatus, comprising:

a crossover sub, the crossover sub having a first sub end with one of a sub pin thread or sub box thread, a second sub end with the other of the sub box thread or sub pin thread, and a fluid passageway extending from the first sub end to the second sub end; and a debris removal tube having a first tube end and a second tube end, the first tube end removably engaged with the crossover sub between the first sub end and the second sub end, wherein the fluid passageway has a first section proximate the first sub end with a first diameter ($d_1$) and a second section proximate the second sub end with a second greater diameter ($d_2$), a difference between the first diameter ($d_1$) and the second greater diameter ($d_2$) forming a crossover sub collection chamber.

* * * * *